US009004661B2

(12) United States Patent
Means et al.

(10) Patent No.: US 9,004,661 B2
(45) Date of Patent: Apr. 14, 2015

(54) DUAL CHAMBER RESERVOIR PRINT HEAD

(71) Applicant: Xerox Corporation, Norwalk, CT (US)

(72) Inventors: John David Means, Newberg, OR (US); Jonathan Robert Brick, Tualatin, OR (US); Jeremiah Dylan Zimmerman, Portland, OR (US); Douglas Dean Darling, Portland, OR (US); Joseph Andrew Broderick, Portland, OR (US); Jeffrey Thomas Flynn, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/964,851

(22) Filed: Aug. 12, 2013

(65) Prior Publication Data

US 2015/0042735 A1 Feb. 12, 2015

(51) Int. Cl.
*B41J 2/18* (2006.01)
*B41J 2/19* (2006.01)

(52) U.S. Cl.
CPC ..... *B41J 2/19* (2013.01)

(58) Field of Classification Search
None
See application file for complete search history.

(56) References Cited

U.S. PATENT DOCUMENTS

| | | | | |
|---|---|---|---|---|
| 2002/0135645 | A1* | 9/2002 | Barinaga et al. | 347/85 |
| 2004/0189742 | A1* | 9/2004 | Kimura et al. | 347/33 |
| 2006/0044365 | A1* | 3/2006 | Sonnichsen et al. | 347/84 |
| 2008/0204501 | A1* | 8/2008 | Kurita et al. | 347/17 |
| 2010/0085396 | A1* | 4/2010 | Yokota et al. | 347/7 |
| 2010/0194798 | A1* | 8/2010 | Asami et al. | 347/7 |
| 2013/0135404 | A1* | 5/2013 | Murray | 347/92 |

* cited by examiner

*Primary Examiner* — Geoffrey Mruk
*Assistant Examiner* — Bradley Thies
(74) *Attorney, Agent, or Firm* — Marger Johnson & McCollom PC

(57) ABSTRACT

The disclosed print head has a two-chamber main reservoir that decouples wasted ink and purge volume in print heads. The two-chamber structure of the print head allows for varying flow of ink through the print head's internal manifolds without varying the wasted ink out of the jet stack. The main reservoir of the print head includes a recirculation chamber and an incoming ink chamber. A vacuum is applied to a vent in the recirculation chamber and a pressure can also be applied to a vent in the incoming ink chamber to cause bubbles in the jet stack to move into the recirculation chamber and be removed through the recirculation chamber vent.

5 Claims, 2 Drawing Sheets

DUAL CHAMBER RESERVOIR PRINT HEAD

BACKGROUND

All print heads having a fluid reservoir require bubble free liquid to exit the reservoir during the printing process, otherwise they will suffer from performance issues. For example, in solid ink printers, ink solidifies when cooled and melts when heated. Heated ink is used during the printing process. When the printer is not being used, such as when the printer is turned off overnight, the ink solidifies. During solidification, the ink contracts and air is introduced into the system. The ink with the air is then re-melted when the printer becomes active again. The air present in the re-melted ink forms bubbles that cause missing jets when the printer attempts to print. In another example, water-based ink printing systems also suffer from the introduction of bubbles into the ink.

All print heads with a fluid reservoir must go through a purging process to rid the ink of the bubbles. Ink is purged out the jet stack faceplate of the print head. The purging process wastes valuable ink. Without purging the ink prior to printing after the ink is re-melted, the print quality is low and print jobs can be ruined. However, purging ink wastes good ink and increases printing costs. An alternative to the purging process in the solid ink example is to keep the ink melted, which means keeping the printer powered on, which significantly reduces the energy efficiency of the printing process. Embodiments of the invention address these and other limitations of the currently available printing systems.

DETAILED DESCRIPTION

Figure 1:
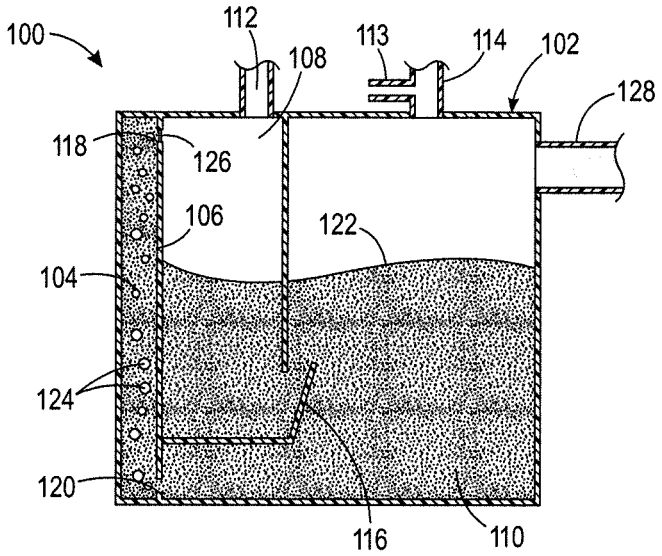
FIG. 1 is an example of the disclosed print head with air bubbles in the jet stack.

Throughout the disclosure, some terms are used frequently and are defined as follows. A print head is an element of a printing apparatus that applies ink to media. A jet stack is the portion of the printing apparatus that includes ejectors for dispensing ink, which can include a silicon chip and associated channels. A main ink reservoir is a container for ink within the print head. A recirculation chamber is a chamber within the main ink reservoir that is in fluid communication with the jet stack. An incoming ink chamber is another chamber within the main ink reservoir. An incoming ink chamber vent is a vent in the incoming ink chamber that allows for applying pressure or vacuum to the incoming ink chamber with air or another gas. A recirculation chamber vent is a vent in the recirculation chamber that allows for applying pressure or vacuum to the recirculation chamber with air or another gas. An incoming ink chamber port is an opening in the incoming ink chamber for ink to enter and exit the incoming ink chamber, which can also be known as an ink feed port.

The ink referenced in any of the disclosed printing apparatuses described herein can be a solid ink, a water-based ink, or any other ink used with a printing apparatus that has a fluid reservoir that requires bubble-free liquid to exit the reservoir. Bubbles refer to any air, gas, or fluid pocket found within the ink of the printing apparatus.

The disclosed print heads are ultra-low purge mass print heads having a fluid reservoir, such as a solid ink print head and any water-based print systems. In the example print heads that use solid ink, the solid ink solidifies in the print head when the ink cools below its melting temperature, such as when the printer is powered off. Solid ink printers are often powered off to conserve energy and for maintenance. When ink in solid ink print heads solidifies, the ink contracts and air is introduced into the system. When the ink is re-melted, such as when the printer is powered on, the air forms bubbles in the re-melted ink that cause missing jets if the printer attempts to print.

A purging process may occur to remove the air bubbles from the re-melted ink prior to printing. During the purging process, a significant amount of wasted ink is removed along with the bubbles. The wasted ink results in higher operational costs and/or a decrease in energy conservation because printers remain powered on to avoid the ink solidification and re-melting process. The introduction of bubbles into ink occurs in many forms, in both solid ink print heads, as just described, and water-based ink printing systems or any other print head having a fluid reservoir requiring bubble-free liquid to exit the reservoir.

The disclosed print head circulates ink within the print head itself to remove air bubbles without purging wasted ink out of the jet stack. Ink may additionally be purged out the jet stack, but the volume of ink purged from the jet stack in the disclosed print head is significantly less than the conventional purging process, which decreases operational costs and increases energy conservation. The volume of ink that is purged out of the jet stack is decoupled from the volume of ink that is recirculated within the print head. Only a small volume of ink is located in the jet stack so the amount of wasted ink resulting from purging the jet stack ink is minimized by using the disclosed two-chamber print head. Conventional methods of purging ink in the print head include purging all of the ink through the jet stack face plate.

Also disclosed is a method of purging bubbles from ink in a print head. The method can be performed by the disclosed two-chamber print head. The method includes applying a vacuum to a recirculation chamber of a main ink reservoir that includes the recirculation chamber and an incoming ink chamber. A jet stack is in fluid communication with and in some examples also positioned adjacent to the main ink reservoir. The applied vacuum causes bubbles in ink located in the jet stack to travel from the jet stack to the recirculation chamber. The bubbles are then removed through a recirculation vent of the recirculation chamber. In some other examples, a pressure is also applied to an incoming ink chamber vent of the incoming ink chamber.

A one-way valve, such as a one-way flapper valve, can be located between the recirculation chamber and the incoming ink chamber. When the vacuum is applied to the recirculation chamber, the one-way valve closes, which seals the recirculation chamber from ink traveling into the recirculation chamber from the incoming ink chamber. Ink travels from the incoming ink chamber, through the jetstack, and into the recirculation chamber. Bubbles are carried along with the ink from the jet stack into the recirculation chamber and are vented out of the print head through the recirculation chamber vent.

Additional remainder bubbles may still be present in the jet stack after the main portion of the bubbles are removed from the recirculation chamber of the print head through the disclosed recirculation purging process. The remainder bubbles can be purged through the face plate of the jet stack in the conventional manner or any other suitable process.

Figure 2:
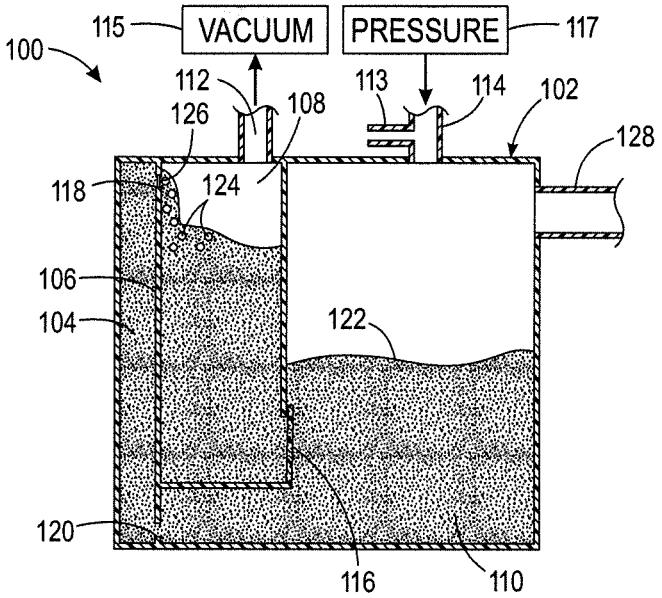
FIG. 2 shows the example print head of FIG. 1 in which the bubbles are moving to a first chamber of the print head.
Figure 3:
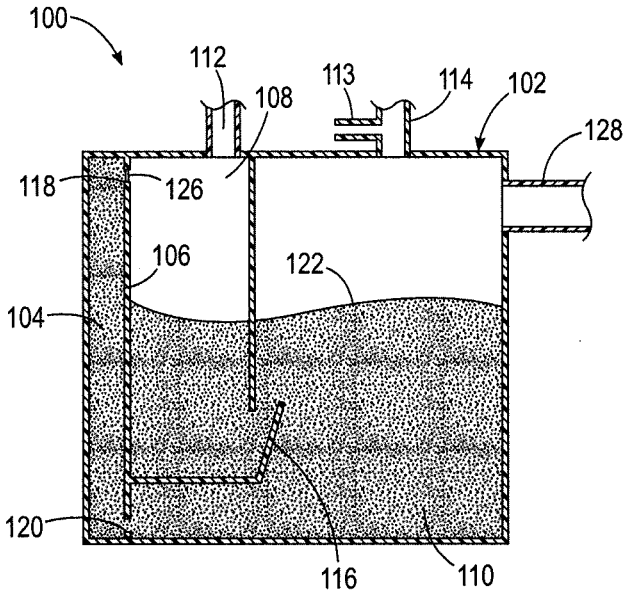
FIG. 3 is the example print head of FIG. 1 after the bubbles have been purged from a second chamber of the print head.

Turning now to FIGS. 1-3, the disclosed print head 100 includes a two chamber main ink reservoir 102 that is in fluid communication with and in this example also positioned adjacent to and separated from a jet stack 104 by a wall 106. The main ink reservoir 102 includes a recirculation chamber 108 and an incoming ink chamber 110. The recirculation chamber 108 and the incoming ink chamber 110 can be any suitable size with respect to each other and are not necessarily equal in size, although they could be. The recirculation chamber 108 includes a recirculation chamber vent 112 to which any suitable pressure can be applied, such as a vacuum source like a vacuum 115 of air or another gas. The incoming ink chamber 110 includes an incoming ink chamber vent 114 to which any suitable pressure can be applied, such as a pressure source like a positive pressure 117 of air or another gas.

The incoming ink chamber 110 also includes an incoming ink chamber port 128 that is an opening in the incoming ink chamber for ink to enter and exit the incoming ink chamber. The incoming ink chamber port 128 can also be known as an ink feed port.

The recirculation chamber 108 and the incoming ink chamber 110 are in fluid communication with each other such that ink can flow between the two chambers. The recirculation chamber 108 and the incoming ink chamber 110 are separated by a one-way valve 116, such as a one-way flapper valve, that allows ink to flow from the recirculation chamber 108 to the incoming ink chamber 110, but does not allow ink to flow from the incoming ink chamber back to the recirculation chamber 108.

The wall 106 separating the jet stack 104 and the main ink reservoir 102 includes a first opening 118 and a second opening 120. The first opening 118 is located between and allows for fluid communication between the jet stack 104 and the recirculation chamber 108. The second opening 120 is located between and allows for fluid communication between the jet stack 104 and the incoming ink chamber 110.

When a vacuum source like vacuum 115 is applied to the recirculation chamber vent 112, ink 122 from the incoming ink chamber 110 and bubbles 124 from the jet stack 104 move into the recirculation chamber 108, as shown in FIG. 2. The first opening 118 acts as a passive valve to allow ink and bubbles to pass from the jet stack 104 to the recirculation chamber 108 as soon as the pressure difference between the jet stack 104 and the recirculation chamber 108 is high enough to break the meniscus 126 formed on the ink at the first opening 118. The passive valve closes when the meniscus 126 forms, or re-forms, across the first opening 118. When the pressure difference is removed, such as when the recirculation chamber 108 is vented to atmosphere, ink drains back into the jet stack 104 until air reaches the recirculation chamber 108 and the meniscus 126 re-forms and prevents ink from draining out of the upper portion of the jet stack 104 due to the back pressure created by the lower ink height in the reservoir tanks.

The main ink reservoir 102 may also include a filtered purge line 113 that is part of the incoming ink chamber vent 114, in some examples. The main ink reservoirs of multiple print heads could be connected to a common filtered purge line. The filtered purge line 113 is connected to the incoming ink chamber of each print head, in some examples with multiple print heads. In the multiple print heads example, all of the main ink reservoirs could share a common air plenum and line, similar to conventional print heads. The incoming ink chambers for each reservoir can also share a common air plenum and line and could also be connected to a common secondary purge system. The secondary purge system provides pressure, vent, and plug, as needed, but only purges the ink from within the jet stack, so the ink volume that is wasted during the secondary purge is minimized.

In a conventional purge tower purge process, ink entering the purge tower (or ink reservoir) drains back into the jet stack, which helps to minimize ink that exits the print head as waste. However, while pressurizing the ink reservoir to purge bubbles, some ink also exits the jet stack as a result of the pressure in the ink reservoir. The fluid paths of the conventional purge towers are balanced and cause a predetermined amount of ink to travel into the towers for a corresponding predetermined amount of ink that exits out the face plate of the jet stack from the pressure in the ink reservoir. The amount of ink required to purge the bubbles from the conventional purge towers corresponds to the amount of ink that exits the jet stack.

By coupling the two-chamber print head, as disclosed herein, with the purge tower, a vacuum can be applied to the recirculation chamber, which causes a large amount of ink to flow through the recirculation chamber and the bubbles to exit through the recirculation chamber vent. When the pressure difference between the recirculation chamber and atmosphere is low enough to maintain a meniscus of ink at the first opening (between the jet stack and the recirculation chamber), additional bubbles are not introduced into the system. When larger ink flows are desired, a combination of applying a vacuum to the recirculation chamber vent and pressure to the incoming ink chamber vent is used to purge the bubbles from the ink in the two-chamber print head.

Further, air flowing in and out of the print head during the purging process can be filtered and controlled by the incoming ink chamber vent 114 and the recirculation chamber vent 112, which provides another layer of preventing contamination of the ink in the print head.

It will be appreciated that variations of the above-disclosed print heads and other features and functions, or alternatives thereof, may be desirably combined into many other different systems, methods, or applications. Also various presently unforeseen or unanticipated alternatives, modifications, variations, or improvements therein may be subsequently made by those skilled in the art.

The invention claimed is:

1. An ink jet printing apparatus, comprising:

a jet stack;

a main ink reservoir in fluid communication with the jet stack, the main ink reservoir having:

a recirculation chamber having a recirculation chamber vent;

an incoming ink chamber having an incoming ink chamber vent; and a one-way valve providing fluid communication between the recirculation chamber and the incoming ink chamber;

a filtered purge line connected to the incoming ink chamber;

a wall separating the jet stack and the main ink reservoir, the wall including:

a first opening between the jet stack and the recirculation chamber; and a second opening between the jet stack and the incoming ink chamber;

ink located in the jet stack, the recirculation chamber, and the incoming ink chamber, wherein at least a portion of the ink located in the incoming ink chamber is moved to the jet stack and the ink in the jet stack is moved to the recirculation chamber when a vacuum is applied to the recirculation chamber vent, the ink moved from the jet stack to the recirculation chamber includes bubbles, and wherein the ink in the incoming ink chamber is moved to the jet stack and the ink in the jet stack is moved to the recirculation chamber when the vacuum is applied to the recirculation chamber vent and a pressure is applied to the incoming ink chamber, the one-way valve structured to be closed when the vacuum is applied to the recirculation chamber vent and the pressure is applied to the incoming ink chamber.

2. The ink jet printing apparatus of claim 1, further comprising a filtered air source coupled to the recirculation chamber vent.

3. The ink jet printing apparatus of claim 1, further comprising a pressure source coupled to the incoming ink chamber vent.

4. The ink jet printing apparatus of claim 1, wherein the one-way valve is a one-way flapper valve.

5. The ink jet printing apparatus of claim 1, wherein the bubbles are removed from the recirculation chamber through the vacuum applied to the recirculation chamber vent.

* * * * *